US006377661B1

(12) United States Patent
Guru et al.

(10) Patent No.: US 6,377,661 B1
(45) Date of Patent: Apr. 23, 2002

(54) RADIATION IMAGER COLLIMATOR

(75) Inventors: Shankar Visvanathan Guru, Clifton Park; Peter Michael Edic, Albany; Reinhold Franz Wirth, Ballston Spa, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/704,634

(22) Filed: Nov. 3, 2000

Related U.S. Application Data

(62) Division of application No. 09/289,819, filed on Apr. 12, 1999, now Pat. No. 6,175,615.

(51) Int. Cl.[7] ..... G21K 1/02

(52) U.S. Cl. ..... 378/149; 378/145; 378/147; 250/515.1

(58) Field of Search ..... 378/145, 149, 378/147, 16, 2; 250/515.1, 505.1

(56) References Cited

U.S. PATENT DOCUMENTS 4,506,374 A * 3/1985 Flynn ..... 378/2
4,910,759 A 3/1990 Sharnoff
5,231,654 A 7/1993 Kwasnick et al.
5,231,655 A 7/1993 Wei et al.
5,239,568 A 8/1993 Grenier
5,293,417 A 3/1994 Wei et al.
5,303,282 A 4/1994 Kwasnick et al.
5,430,298 A 7/1995 Possin et al.
5,524,041 A 6/1996 Grenier
5,644,615 A 7/1997 Van der Borst et al.
5,834,780 A * 11/1998 Morgan et al. ..... 250/363.04

* cited by examiner

*Primary Examiner*—David V. Bruce
*Assistant Examiner*—Pamela R. Hobden
(74) *Attorney, Agent, or Firm*—Donald S. Ingraham; Christian Cabou

(57) ABSTRACT

A collimator 100 for use in a radiation imaging system 10, and a method for making such collimators, are provided, wherein the collimator 100 is capable of collimating radiation in two orthogonal planes. The collimator in one embodiment includes a block 101 of radiation absorbing material having a plurality of focally aligned channels 102 extending therethrough; in a second embodiment, the collimator includes first and second collimation 204, 212 sections having a respective first plurality of focally aligned plate sets 201 and a respective second plurality of focally aligned plate sets 203 disposed orthogonally to the first plurality of plate sets. The method for making the collimator includes generating a CAD drawing, generating from the CAD drawing one or more stereo-lithographic files, and using the stereo-lithographic files to control an electro-deposition machining machine which creates the channels in the block.

9 Claims, 6 Drawing Sheets

20
10
90
40
50
30
42
SIGNAL PROCESSING
IMAGE ANALYSIS & DISPLAY
60
70

RADIATION IMAGER COLLIMATOR

This application is a division of application Ser. No. 09/289,819, filed Apr. 12, 1999 now U.S. Pat. No. 6,175,615, which is hereby incorporated by reference in its entirety.

BACKGROUND OF THE INVENTION

The invention relates generally to radiation imagers, and in particular to focused collimators used in conjunction with radiation detection equipment.

Collimators are used in a wide variety of equipment in which it is desired to permit only beams of radiation emanating along a particular path to pass beyond a selected point or plane. Collimators are frequently used in radiation imagers to ensure that only radiation beams emanating along a direct path from the known radiation source strike the detector, thereby minimizing detection of beams of scattered or secondary radiation. Collimator design affects the field-of-view, spatial resolution, and sensitivity of the imaging system.

Particularly in radiation imagers used for medical diagnostic analyses or for non-destructive evaluation procedures, it is important that only radiation emitted from a known source and passing along a direct path from that source through the subject under examination be detected and processed by the imaging equipment. If the detector is struck by undesired radiation, i.e., radiation passing along non-direct paths to the detector, such as rays that have been scattered or generated in secondary reactions in the object under examination, performance of the imaging system is degraded. Performance is degraded by lessened spatial resolution and lessened contrast resolution that result from the detection of the scattered or secondary radiation rays.

Collimators are positioned to substantially absorb the undesired radiation before it reaches the detector. Collimators are traditionally made of a material that has a relatively high atomic number, such as tungsten, placed so that radiation approaching the detector along a path other than one directly from the known radiation source strikes the body of the collimator and is absorbed before being able to strike the detector. In a typical detector system, the collimator includes barriers extending outwardly from the detector surface in the direction of the radiation source so as to form channels through which the radiation must pass in order to strike the detector surface.

Some radiation imaging systems, such as computed tomography (CT) systems used in medical diagnostic work, or such as industrial imaging devices, use a point (i.e. a relatively small, such as 1 mm in diameter or smaller) source of x-ray radiation to illuminate the subject under examination. The radiation passes through the subject and strikes a radiation detector positioned on the side of the subject opposite the radiation source. In a CT system, the radiation detector typically comprises a one-dimensional array of detector elements. Each detector element is disposed on a module, and the modules are typically arranged end to end along a curved surface to form a radiation detector arm. The distance to the center of the module, on any one of the separate modules is the same, i.e., each panel is at substantially the same radius from the radiation source. On any given module there is a difference from one end of the module to the other in the angle of incidence of the radiation beams arriving from the point source.

For example, in a common medical CT device, the detector is made up of a number of x-ray detector modules, each of which has dimensions of about 32 mm by 16 mm, positioned along a curved surface having a radius of about 1 meter from the radiation point source. Each detector module has about 16 separate detector elements about 32 mm long by 1 mm wide arranged in a one-dimensional array, with collimator plates situated between the elements and extending outwardly from the panel to a height above the surface of the panel of about 8 mm. As the conventional CT device uses only a one-dimensional array (i.e., the detector elements are aligned along only one row or axis), the collimator plates need only be placed along one axis, between each adjoining detector element. Even in an arrangement with a panel of sixteen 1 mm-wide detector elements adjoining one another (making the panel about 16 mm across), if the collimator plates extend perpendicularly to the detector surface, there can be significant "shadowing" of the detector element by the collimator plates towards the ends of the detector module. This shadowing results from some of the beams of incident radiation arriving along a path such that they strike the collimator before reaching the detector surface. Even in small arrays as mentioned above (i.e. detector panels about 16 mm across), when the source is about 1 meter from the panel with the panel positioned with respect to the point source so that a ray from the source strikes the middle of the panel at right angles, over 7.5% of the area of the end detector elements is shadowed by collimator plates that extend 8 mm vertically from the detector surface. Even shadowing of this extent can cause significant degradation in imager performance as it results in non-uniformity in the x-ray intensity and spectral distribution across the detector module. In the one-dimensional array, the collimator plates can be adjusted slightly from the vertical to compensate for this variance in the angle of incidence of the radiation from the point source.

Advanced CT technology (e.g., volumetric CT), however, makes use of two-dimensional arrays, i.e., arrays of detector elements that are arranged in rows and columns. The same is true of the precision required for industrial imagers. In such an array, a collimator must separate each detector element along both axes of the array. The radiation vectors from the point source to each detector on the array have different orientations, varying both in magnitude of the angle and direction of offset from the center of the array. Additionally, detector arrays larger than the one-dimensional array discussed above may be advantageously used in imaging applications. As the length of any one panel supporting detector elements increases, the problem of the collimator structure shadowing large areas of the detector surface become more important. In any system using a "point source" of radiation and flat panels, some of the radiation beams that are desired to be detected, i.e., ones emanating directly from the radiation source to the detector surface, strike the detector surface at some angle offset from vertical.

SUMMARY OF THE INVENTION

In a radiation detecting system in which the radiation desired to be detected is emitted from a single point source, a two-dimensional collimator is provided which has channels that allow radiation emanating along a direct path from the point source to pass through to underlying radiation detectors while substantially all other radiation beams striking the collimator are absorbed. The axis of each channel has a selected orientation angle so that it is substantially aligned with the direct beam path between the radiation point source and the underlying radiation detector element. The collimator typically comprises two sets of focusing collimator plates, disposed orthogonal to each other.

A method of fabricating a collimator is also provided, which includes the steps of generating a computer-aided-drawing (CAD) drawing of a two-dimensional (2D) collimator based upon overall imager system parameters, generating a stereo-lithographic (STL) file or files corresponding to the CAD drawing and to the chosen size, position and orientation of the focally aligned channels to be formed in the collimator, and interfacing the STL files with machining equipment to machine out the material to be removed from a solid slab (workpiece) of radiation-absorbing material, to form the plurality of focally aligned channels extending through the workpiece.

BRIEF DESCRIPTION OF THE DRAWINGS

These and other features, aspects, and advantages of the present invention will become better understood when the following detailed description is read with reference to the accompanying drawings, wherein.

DETAILED DESCRIPTION OF THE INVENTION

Figure 1:
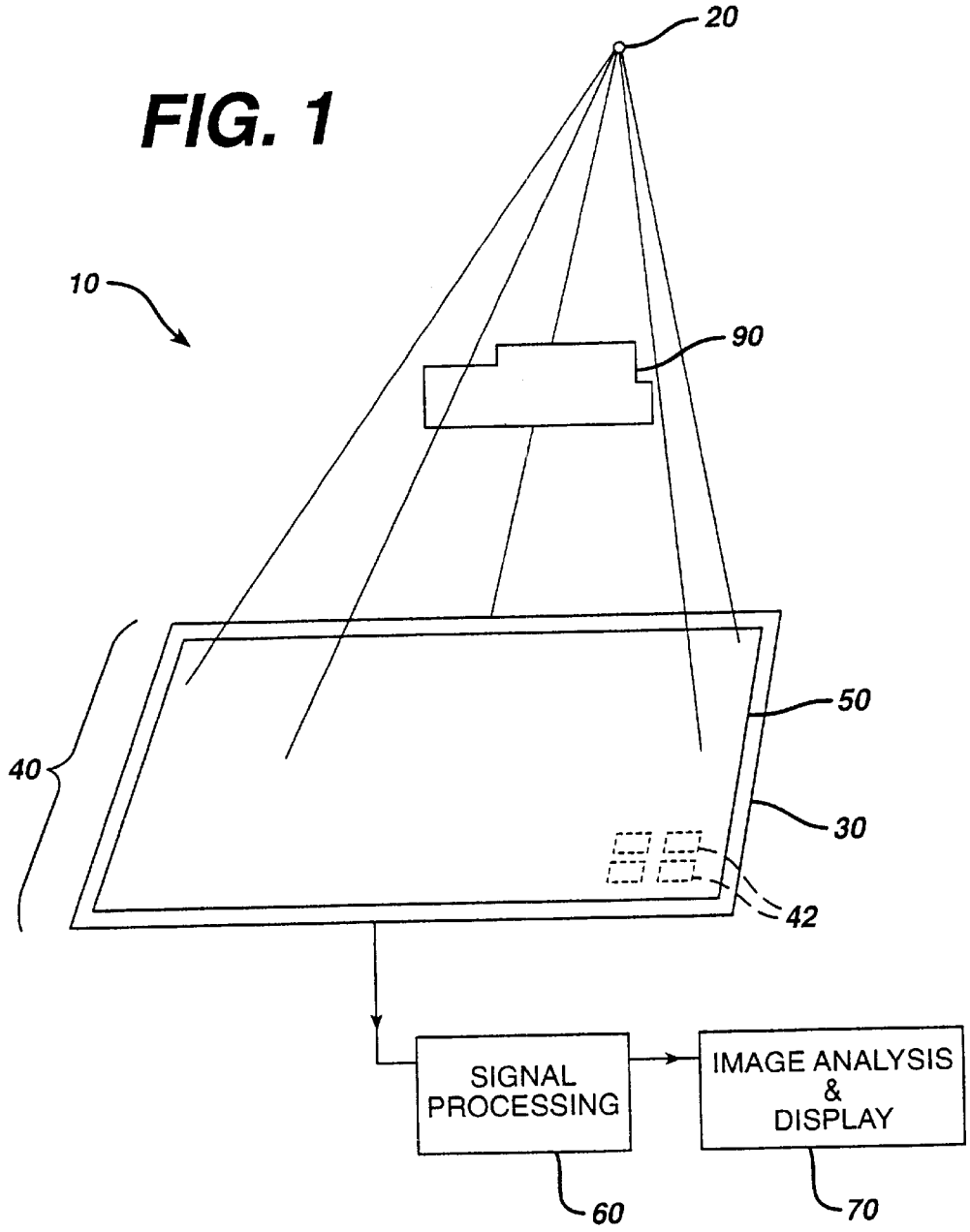
FIG. 1 is a schematic representation of an imaging system incorporating the collimator of the present invention.

A radiation imager system 10, such as a computed tomography (CT) system, incorporating the device of the present invention is shown in schematic form in FIG. 1. CT system 10 comprises a radiation point source 20 and a radiation detector 30 and a collimator 50 disposed between radiation source 20, typically an x-ray source, and detector panel 40. Radiation detector 30 typically comprises a panel 40 having an array of photosensor pixels 42 (only a few of which are shown in phantom for purposes of illustration) coupled to a scintillator (not shown) that together convert incident radiation into electrical signals. The detector elements in conventional CT systems are arranged in a one-dimensional array. Advanced volumetric CT systems have detector elements arranged in two-dimensional array, as illustrated in FIG. 1. The radiation detector elements are coupled to a signal processing circuit 60 and thence to an image analysis and display circuit 70.

This FIG. 1 arrangement allows an object or subject 90 to be placed at a position between the radiation source and the radiation detector, for examination or inspection of the object or subject. Collimator 50 is positioned over radiation detector panel 40 to allow passage of radiation beams that emanate along a direct path from radiation source 20, through exam subject 90, and to radiation detector panel 40, while absorbing substantially all other beams of radiation that strike the collimator. The construction of embodiments of the present invention for collimator 50, as well as the details of the fabrication of these collimators, are discussed in detail below.

Figure 2:
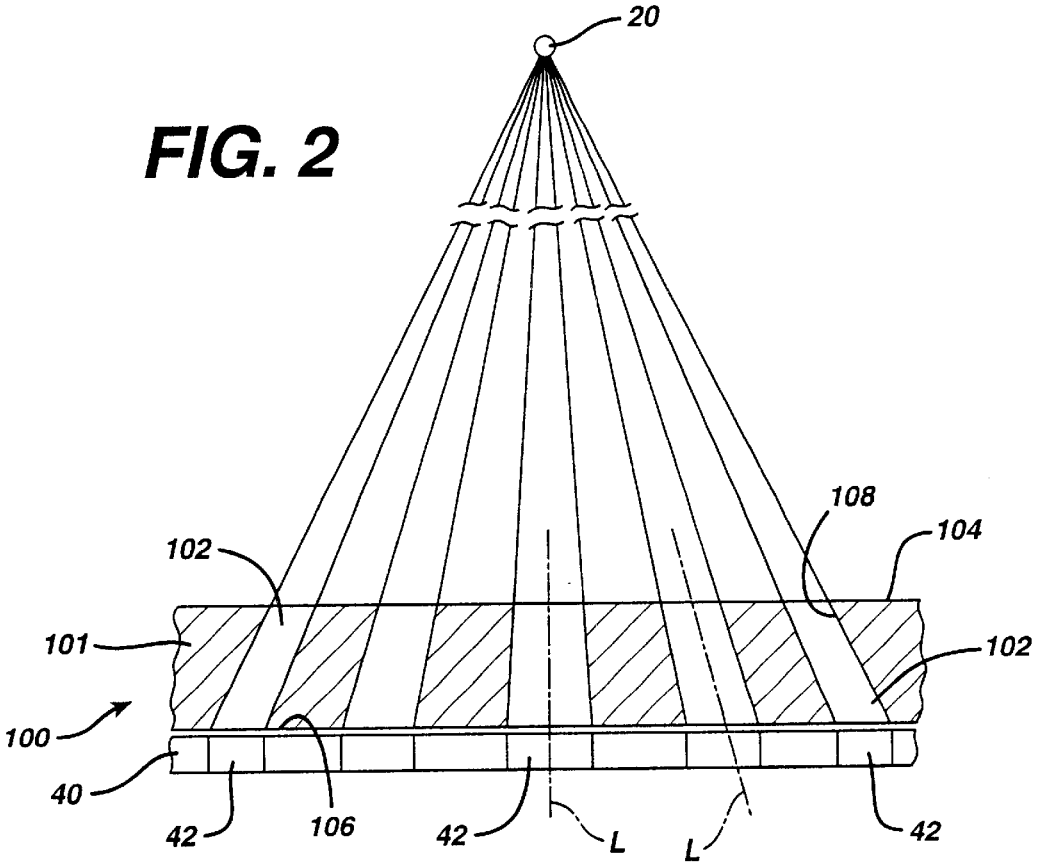
FIG. 2 is a cross-sectional view of a collimator in accordance with an embodiment of the present invention.
Figure 3:
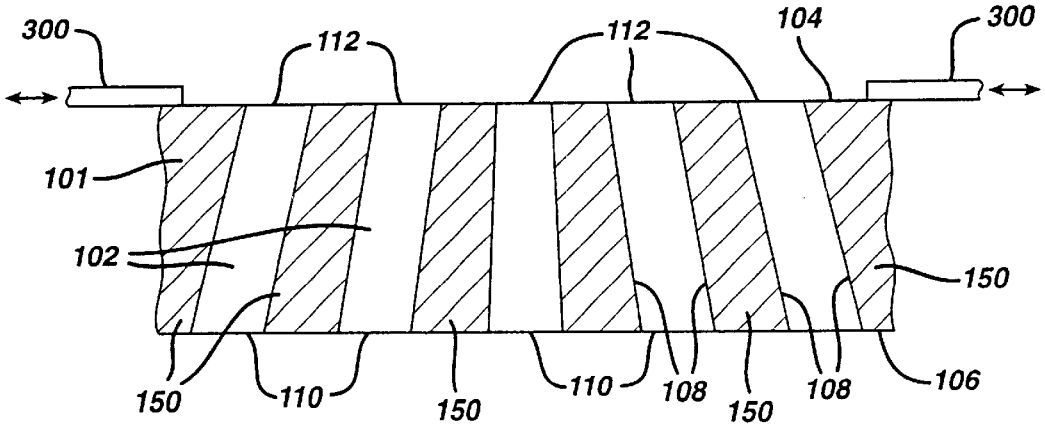
FIG. 3 is a further cross-sectional view of a collimator in accordance with an embodiment of the present invention.

FIG. 2 is a cross-sectional view of a representative portion of a first embodiment of the collimator of the present invention. FIG. 3 is a slightly larger cross-sectional view of collimator 100. Collimator 100 is preferably fabricated from a solid, monolithic block or slab of a radiation absorbent material, such as tungsten. A plurality of channels or passages 102 are formed in the slab, extending completely through the slab from a first surface 104 to a second surface 106.

The channels 102 extending through collimator 100 are "focally aligned", meaning that each of the channels has a central longitudinal axis L aligned or collinear with a respective orientation angle of the radiation source, such that extensions of the longitudinal axes L converge at a point corresponding to the position of radiation point source 20 in the imager assembly, as shown by the converging lines in FIG. 2. In that way, the channels 102 permit radiation originating at the radiation point source to pass through the collimator 100 to impinge upon detector 40. At the same time, the channels are oriented such that scattered or stray radiation not originating at or traveling directly from the radiation point source will impinge upon a portion of the collimator 100, such as first surface 104, or a wall 108 of a channel, and be absorbed by the collimator material prior to the radiation reaching a detector element 42. As a result, substantially the only radiation reaching the detector 40 will be radiation emanating directly from the radiation source 20 which passes through the object or subject 90, and which continues through to the detector. The image obtained is therefore minimally degraded by detection of scattered radiation.

The fabrication process for producing collimators in accordance with the FIG. 2 embodiment advantageously permits custom design or tailoring of the collimator for different imaging situations, or for use in imaging devices having different configurations. As noted previously, the collimator is preferably formed from a single monolithic slab of a high atomic number material (e.g., an atomic number of about 72 or greater) which can absorb radiation of the type intended to be employed in a particular radiation detector or imager. This slab may be of a thickness on the order of several millimeters (e.g., 2–10 mm), with the thickness depending upon the energy of the radiation to be used and the imaging precision required, for example.

Figure 4:
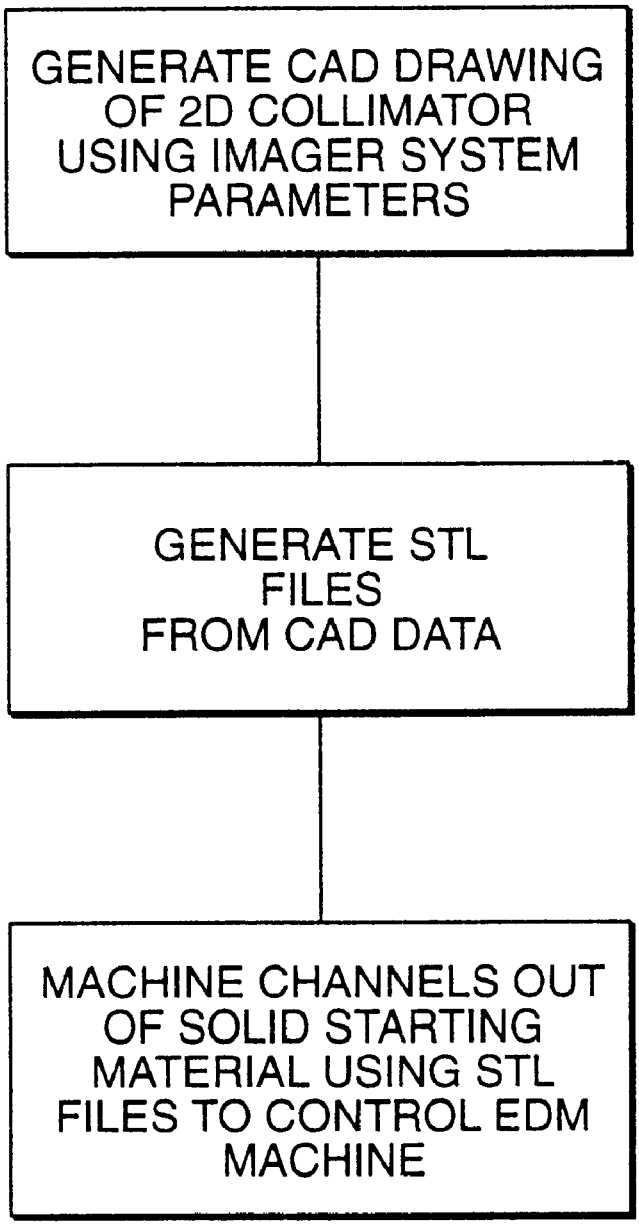
FIG. 4 is a flow diagram presenting the method for fabricating a collimator in accordance with the present invention.

As seen in the flow diagram of FIG. 4, the fabrication process begins with the use of a CAD (computer aided design) program, which generates a drawing of a two-dimensional collimator based upon overall imager system parameters, including the distance at which the collimator 100 will be placed from the radiation point source 20 in the imaging device, the size and position or location of the detector elements 42 on detector 40, and the spacing distance, if any, between the collimator 100 and detector 40.

The CAD program preferably generates digital data files referred to as stereo-lithographic (STL) files. The CAD drawing or STL files contain information which defines the position, size, and orientation of the channels 102 which will extend through collimator 100 once fabrication is completed.

In general, the size, orientation and position of the channels is determined by the distance of the collimator 100 from the radiation point source 20 in a given imager system, the size and location of the individual detector elements 42 on the detector panel 40, and the distance, if any, between the collimator 100 and the detector panel 40. The exit opening 110 of each of the channels 100 typically is sized and shaped to correspond to the size of the detector element 42 disposed adjacent to that channel. Where the collimator is not disposed in intimate contact with the detector panel 40, the sizing of the exit opening typically is also designed to account for spacing between the collimator 100 from the detector panel so as to allow the radiation passing from the collimator to be incident over the surface area of the respective detector elements 42. Based on the size and shape of the exit openings 110, the channel will generally have tapered walls which extend along imaginary planes defined by the respective edges of the exit opening 110 and the radiation point source 20. The size and position of the entrance openings 112 to the channels of the collimator 100 are thus dictated by the tapering walls 108 (that is, the dimensions of the channel are greater at first surface 104 of the collimator than at second surface 106 of the collimator) of the channels at the point that the channels reach the first or front surface 104 of the collimator.

Figure 5:
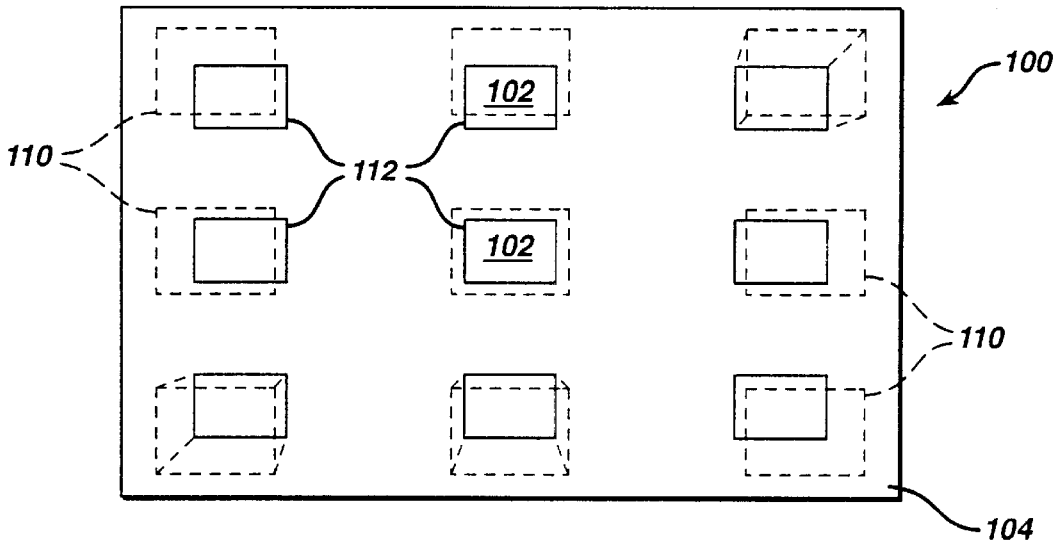
FIG. 5 is a partial front plan view of a collimator in accordance with an embodiment of the present invention.

The exit and entrance openings 110, 112, respectively, on a collimator 100 designed for use with a two dimensional array of detector elements are schematically illustrated in FIG. 5. This figure shows entrance openings 112 in solid lines and exit openings 110 in broken lines. The geometric complexity of the channels and the differences in geometry from channel to channel can be better appreciated in this view as well.

The generated STL files are typically used for control of a machining device, such as an electro-deposition machining (EDM) device, to machine out the material from block 101 to create the geometrically complex channels 102 which extend through the finished collimator. The geometric complexity of the channels is a result of the fact that the entrance and exit openings of the channels, and angles of orientation of the channels relative to the front and rear surfaces 104, 106 (respectively) of the collimator may all vary as a function of their distance from a central axis extending from the front surface of the collimator through a center of the radiation source 20.

The CAD program and STL files generated permit the precise machining of these highly complex channels. In addition, a significant advantage of using CADISTL files is that collimators having different channel characteristics can readily be made by revising the drawings or files or creating new drawings or files based on the device parameters which may be different for different imaging devices or for different imaging conditions in the same imaging device.

As a result, this focally-aligned 2D collimator design and fabrication process have a great deal of flexibility despite the complexity of machining the many different channel configurations, and of machining at compound angles relative to the surfaces of the collimator. Collimators can thus be fabricated which are optimized for varying end uses. Generally, high energy (approximately 320–450 KeV) industrial x-ray imagers will be larger and have greater slab thicknesses and wall thicknesses (thickness of the material separating adjacent channels) to enhance the ability of the collimator to block the undesired radiation from reaching the detector 40. Collimators optimized for use with somewhat lower x-ray energies, used in medical imaging (approximately 120 KeV), for example, may have one or more of the following characteristics so as to be adapted for use in a medical system: a smaller slab thickness, or a thinner wall thickness.

Two-dimensional collimators 100 as described above serve to reduce or suppress detection of scatter radiation. Due to the fact that such collimators have a substantial thickness (as noted above), as compared with thin sheets having collimation openings therein (e.g., openings over one or more detector columns or rows) and due to the fact that the web 150 of the collimator remaining after the channels have been machined is also of relatively substantial thickness (e.g., about 2 mm to about 10 mm of a high atomic number material for high energy x-rays in an industrial CT system), if the collimator is installed in a stationary position in the imager system, it is necessary to conduct an oversampling of the source distribution (e.g., a 4× sampling) to ensure that the detector elements of pixels 42 obtain an accurate image of the entire object being imaged, and not one with discrete sections corresponding to the grid of channels.

Optionally, the imager system can be designed such that the collimator 100 is mounted to a vibrating platform 300 (FIG. 3) that will move the collimator 100 relative to the detector panel 40 such that the exit openings of the channels move to expose the detector elements to non-scattered radiation that otherwise would have been blocked or absorbed by the web portion 150 of the collimator. The platform vibration would be set such that each detector pixel sees the collimator walls and the exit opening of the channel for the same amount of time to ensure evenness (that is, uniformity) of exposure.

Figure 6:
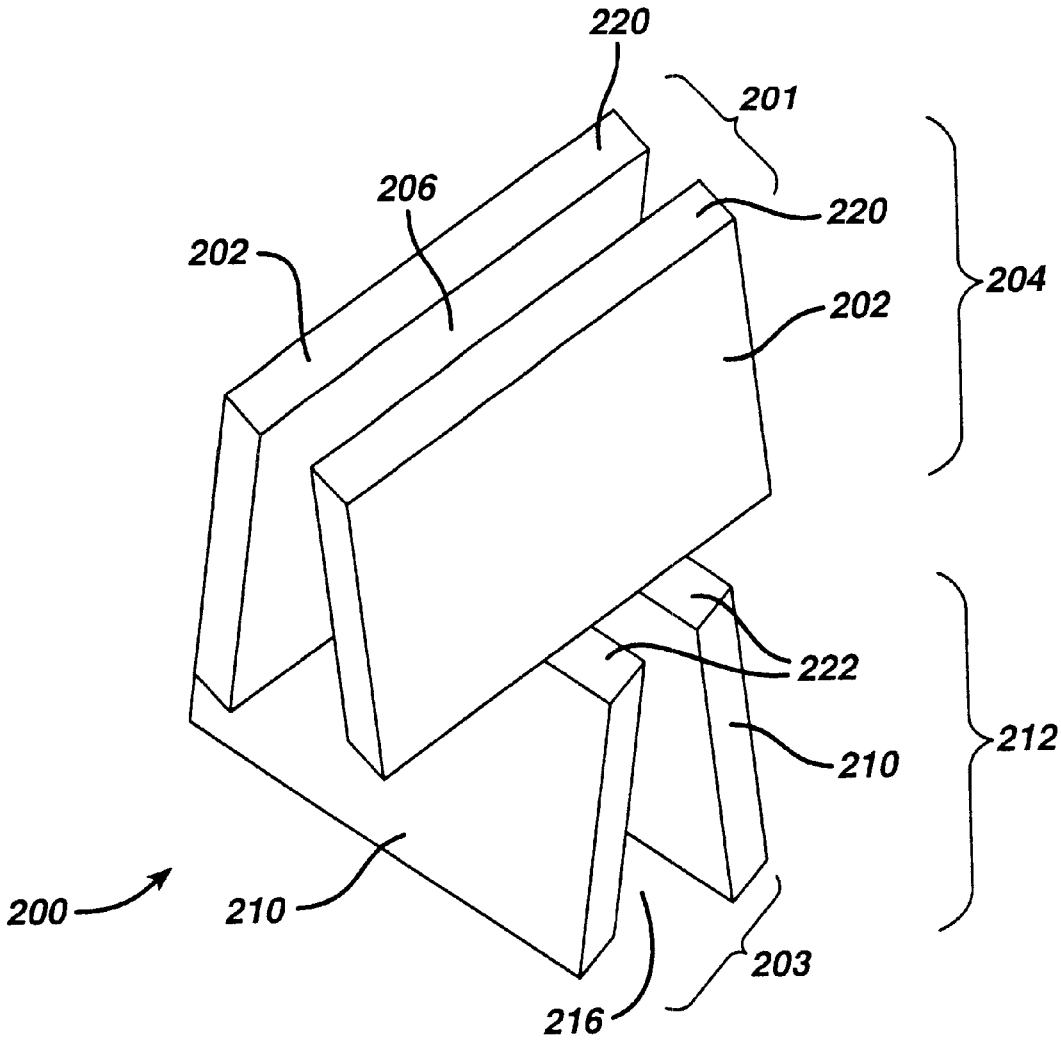
FIG. 6 is a substantially schematic partial perspective view of a collimator according to an alternative embodiment of the present invention.
Figure 7:
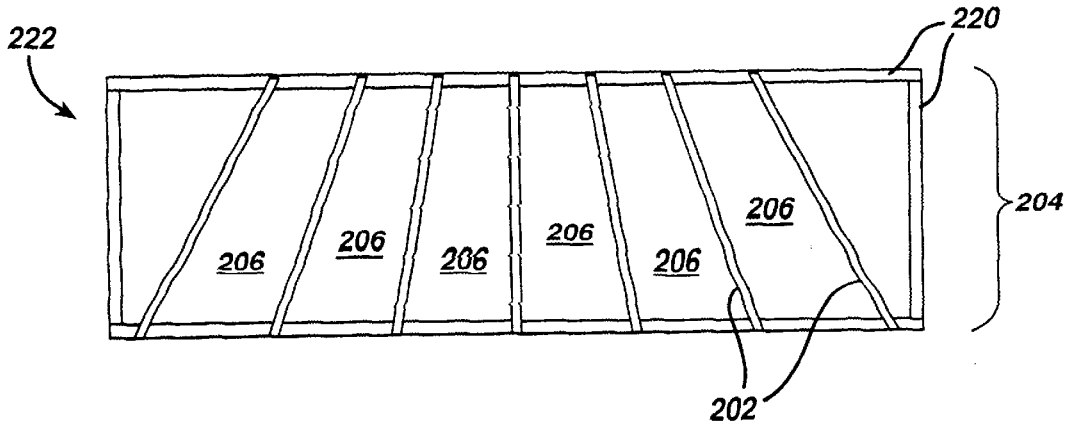
FIG. 7 is an end view of a collimation section according to the alternative preferred embodiment of the invention.
Figure 8:
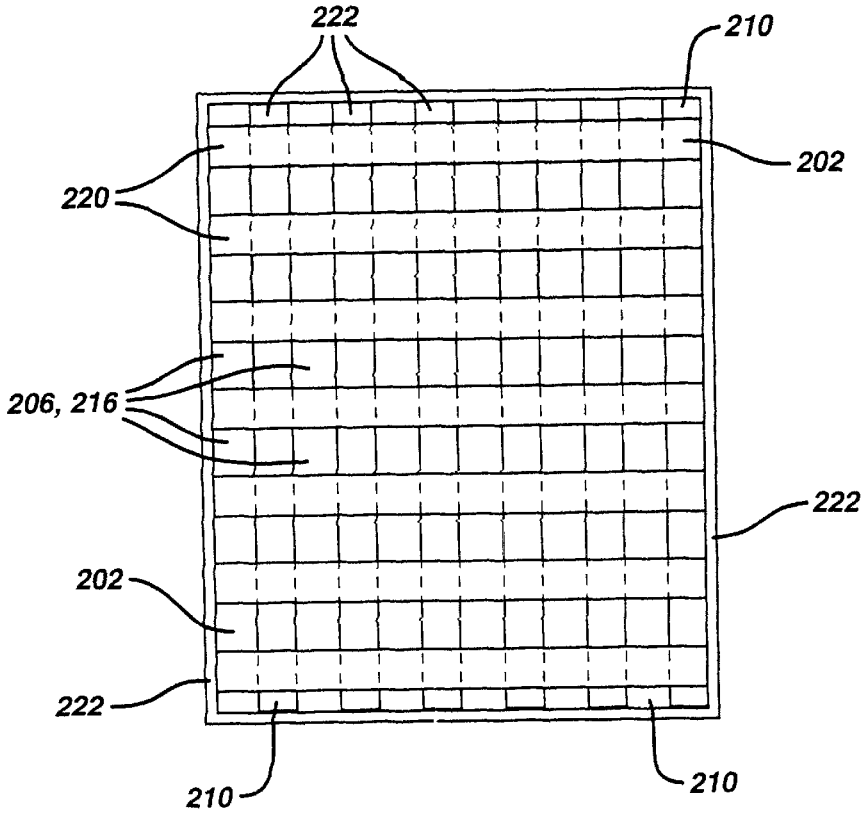
FIG. 8 is a top plan view of a collimator according to the alternative embodiment of the present invention.

An alternative embodiment of the present invention is schematically illustrated in FIGS. 6, 7 and 8. This alternative embodiment approximates the performance of the focally aligned 2D collimator of FIG. 2 by performing a one-dimensional (1D) collimation in a first plane, immediately followed by a further 1D collimation in a second plane which is orthogonal to the first plane. The net effect of the two collimations approximates the effectiveness and performance of a 2D collimator, and is generally superior to the effectiveness of a 1D collimator.

Collimator 200 comprises first collimation section 204, which is made up of a plurality of first plate sets 201 (a representative one of which is illustrated in FIG. 6) of collimator plates 202. Each of the first plate sets 204 define a focally aligned (as that term is used herein) passage 206 adapted to allow to pass therethrough incident radiation emanating from a radiation point source. The axis of the passage is defined in a plane between the radiation point source and an underlying row (or other configuration) of detectors. In a conventional 1D collimator, scattered x-ray photons are prevented from reaching the detector in the plane of collimation of the collimator, but scattered photons originating in the plane orthogonal to that are not suppressed from reaching the detector elements.

In this embodiment, collimator 200 further comprises a second collimation section 212. Second collimation section comprises a plurality of second plate sets 203. Second plate sets comprise collimator plates 210 that are positioned to create a respective focally aligned passages 216 arranged to collimate in a plane orthogonal to the plane of collimation of the first collimation section. The structure of the second collimation section will be essentially identical to that of the first collimation section, with the possible exception that the plates may be arranged such that passages 216 are adjusted to account for the different distance or spacing from the point source 20. Otherwise, the second collimation section appears, in end view, essentially identical to the first collimation section illustrated in FIG. 7.

Collimator plates comprise a material selected to provide a desired level of attenuation given design information on energy level of x-ray radiation in the system and the imaging geometry used. Commonly, materials such as tungsten, lead, and natural uranium are efficacious collimator materials for use in imaging systems of the present invention.

As seen in the substantially schematic illustrations in FIGS. 7 and 8, the plates of each of the first and second collimation sections are joined in fixed relationship to each other by a plurality of brackets 220 which make up a frame 222. The first and second collimation sections are also preferably secured in position relative to each other by brackets which also make up part of frame 222. One example of frame 222 comprises a box-type structure of a material transparent to the x-ray radiation (e.g., plastic or the like) that is fabricated to provide brackets (or grooves) 220 that receive collimator plates. For the 2-D arrangement, each of first and second collimator sections 204, 212, comprise a respective frame 222. The frames are disposed orthogonal to one another to provide the desired 2-D collimator structure. The collimator sections are typically fastened to the detector assembly (e.g., with bolts, snaps, or the likes) such that the sections can be removed and repositioned, if necessary.

The collimator 200 is structured such that radiation passes successively through first collimation section 204 and second collimation section 212, with the effect that radiation not emanating directly from the radiation point source is, in large part, absorbed by plates of either the first or second collimation section. Collimator 200 thus is often referred to as a pseudo-2D or hybrid-2D collimator. FIG. 8, which illustrates the orthogonal orientation of plates 202 of first collimation section 204 and plates 210 of second collimation section 212, shows that passages 206 and 216, in combination and in succession, approximate the channels 102 of the collimator 100 according to the first preferred embodiment. For the purposes of clarity, only the leading edges 220, 222 of plates 202, 210, respectively, are shown in the view of FIG. 8. The broken lines illustrate that plates 210 are disposed underneath plates 202 in this illustration.

In simulations conducted using a model of the collimator 200 shown in FIGS. 6, 7 and 8, this embodiment of the collimator demonstrated performance comparable to a true 2D collimator under moderate scatter conditions, such as are experienced in medical x-ray imaging. For example, for a given workpiece and energy of x-rays, the amount of the scatter signal reaching the detector array is typically less than about 20% of the primary x-ray signal reaching the array, and generally is between about 5% to about 10% of the primary signal reaching the array. The amount of scatter (e.g., the scatter signal as a percent of primary signal, is commonly less is medical imaging than in industrial imaging, where the composition and the geometry of parts being imaged generally contribute to a higher amount of scatter of incident x-rays. In extreme scatter conditions, such as are experienced in industrial x-ray imaging, the performance of collimator 200 is degraded. Nonetheless, given the relatively more complex design and fabrication of a true 2D collimator, there are many applications where the pseudo-2D collimator 200 would provides a desirable combination of performance and production cost.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An imaging system comprising:

a radiation point source;

at least one detector panel having an array of detector elements disposed thereon; and a collimator comprising a radiation absorbing material, said collimator being disposed at a position between said radiation point source and said detector panel, said collimator further comprising a monolithic block of a radiation-absorbing material having a front face and a rear face, a plurality of channels formed within and through said block, each of said channels being separated by and defined by a plurality of channel walls that collectively comprise a web of said radiation absorbing material, said web being the portion of the slab material remaining after said plurality of channels are formed in said slab;

wherein each of said plurality of channels has a longitudinal axis, and said longitudinal axes of said plurality of channels intersect at a position of said radiation point source, and wherein said walls forming each of said plurality of channels converge toward said radiation point source position.

2. An imaging system as recited in claim 1 wherein said radiation-absorbing material is selected from the group consisting of tungsten, lead, and natural uranium.

3. An imaging system as recited in claim 1 wherein said radiation absorbing material has an atomic number not less than about 72.

4. An imaging system as recited in claim 1 wherein said collimator further comprises:

An imaging system comprising:

a radiation point source;

at least one detector panel having an array of detector elements disposed thereon; and a collimator comprising a radiation absorbing material, said collimator being disposed at a position between said radiation point source and said detector panel, said collimator further comprising a first collimation section made up of a plurality of first plate sets of said radiation absorbing material, each of said plurality of first plate sets being disposed so as to define a passage between plates in the set, each of said passages having a respective longitudinal axis lying in a plane defined by said radiation point source and a predetermined row of said array of detector elements, and a second collimation section disposed adjacent said first collimation section, said second collimation section comprising a plurality of second plate sets of said radiation absorbing material, each of said plurality of second plate sets defining a passage between plates in set, said passages of said second collimation section being oriented orthogonally to said passages of said first collimation section, each of said passages of said second collimation section having a longitudinal axis lying in a plane defined by said radiation point source and a predetermined column of said array of detector elements, the first and second collimation sections being disposed in a fixed relationship to one another so as to produce a plurality of channels having respective longitudinal axes disposed along a direct path between said radiation point source and said array of detector elements.

5. An imaging system as in claim 4, wherein said first collimation section and said second collimation section are disposed in respective frames, said frames comprising a material that is substantially transparent to x-ray radiation.

6. An imaging system as in claim 4 wherein said first and second collimation sections are detachably fastened to one another and to said detector array.

7. An imaging system comprising:

a radiation point source;

at least one detector panel having an array of detector elements disposed thereon; and a collimator comprising a radiation absorbing material, said collimator being disposed at a position between said radiation point source and said detector panel;

said collimator further comprising a first collimation section made up of a plurality of first plate sets, each of said plates sets comprising plates of a radiation absorbing material and disposed with respect to one another so as to define a respective passage between plates in a plate set, each of said passages defining a respective plate set longitudinal plane positioned equidistantly from the two plates in said respective plate set, said respective longitudinal planes of said plurality of respective first plate set passages intersecting at a line disposed a predetermined distance away from a front edge of said first collimation section; and a second collimation section disposed adjacent said first collimation section, said second collimation section comprising a plurality of second plate sets comprising respective plates of a radiation absorbing material and disposed with respect to one another so as to define a respective passage between plates in a respective plate set, each of said passages defining a respective plate set longitudinal plane positioned equidistantly from the two plates in said respective plate set, said respective longitudinal planes of said plurality of passages intersecting at a line disposed at said predetermined distance away from said front edge of said first collimation section, said second collimation section being oriented orthogonal to said first collimator section such that said line of intersection of said longitudinal planes of said passages of said first collimation section and said line of intersection of said longitudinal planes of said passages of said second collimation section intersect at a point at said predetermined distance, and such that radiation from a radiation point source located at said point is collimated in two orthogonal planes.

8. An imaging system as recited in claim 7 wherein said plates of said first collimation section and said plates of said second collimation section are retained in position by a plurality of brackets to secure said plates in position.

9. An imaging system as recited in claim 7 wherein said plates of said first and said second collimation sections comprises material selected from the group consisting of tungsten, lead, and natural uranium.

* * * * *

UNITED STATES PATENT AND TRADEMARK OFFICE

CERTIFICATE OF CORRECTION

PATENT NO. : 6,377,661 B1
DATED : April 23, 2002
INVENTOR(S) : Shankar V. Guru et al.

It is certified that error appears in the above-identified patent and that said Letters Patent is hereby corrected as shown below:

Column 1,
Line 7, before the first heading "BACKGROUND OF THE INVENTION", please insert:

-- STATEMENT REGARDING FEDERALLY SPONSORED RESEARCH AND DEVELOPMENT

The U.S. Government may have certain rights in this invention pursuant to contract number 70NANB5H1148 awarded by the NIST (National Institute of Standards & Technology). --

Signed and Sealed this

Third Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,377,661 B1
DATED : April 23, 2002
INVENTOR(S) : Guru et al.

It is certified that error appears in the above-identified patent and that said Letters Patent is hereby corrected as shown below:

Column 8,
Lines 28-30, delete "An imaging system as recited in claim 1 wherein said collimator further comprises:"

Signed and Sealed this

First Day of April, 2003

JAMES E. ROGAN
*Director of the United States Patent and Trademark Office*